US010240759B2

(12) United States Patent
Chami et al.

(10) Patent No.: US 10,240,759 B2
(45) Date of Patent: Mar. 26, 2019

(54) MODULAR LIGHTING FIXTURE

(71) Applicant: MaxLite, Inc., West Caldwell, NJ (US)

(72) Inventors: Aymen Chami, North Brunswick, NJ (US); Gregory Galluccio, Hauppauge, NY (US)

(73) Assignee: MAXLITE, Inc., West Caldwell, NJ (US)

( * ) Notice: Subject to any disclaimer, the term of this patent is extended or adjusted under 35 U.S.C. 154(b) by 47 days.

(21) Appl. No.: 15/463,831

(22) Filed: Mar. 20, 2017

(65) Prior Publication Data

US 2017/0268756 A1 Sep. 21, 2017

Related U.S. Application Data

(60) Provisional application No. 62/310,377, filed on Mar. 18, 2016.

(51) Int. Cl.

| | |
|---|---|
| ***F21V 21/005*** | (2006.01) |
| ***F21V 15/015*** | (2006.01) |
| ***F21V 31/00*** | (2006.01) |
| *F21Y 115/10* | (2016.01) |
| *F21Y 103/00* | (2016.01) |

(52) U.S. Cl.
CPC ..... *F21V 21/005* (2013.01); *F21V 15/015* (2013.01); *F21V 31/005* (2013.01); *F21Y 2103/00* (2013.01); *F21Y 2115/10* (2016.08)

(58) Field of Classification Search
CPC .... F21V 21/005; F21V 15/015; F21V 31/005; F21V 21/088; F21V 15/00; F21V 19/003; F21V 19/004; F21V 15/01; F21V 31/00; F21V 17/10; F21Y 2115/10; F21Y 2103/00
See application file for complete search history.

(56) References Cited

U.S. PATENT DOCUMENTS

| | | | | |
|---|---|---|---|---|
| 2012/0092875 | A1* | 4/2012 | Cho | F21S 2/005 362/311.01 |
| 2014/0071668 | A1* | 3/2014 | Ai | F21S 2/00 362/219 |
| 2015/0109804 | A1* | 4/2015 | Parekh | F21V 19/004 362/398 |
| 2015/0159848 | A1* | 6/2015 | Sieberth | F21V 23/06 362/311.02 |
| 2015/0267899 | A1* | 9/2015 | Baright | F21V 15/01 362/223 |
| 2015/0377475 | A1* | 12/2015 | Ji | F21V 31/005 362/374 |

* cited by examiner

*Primary Examiner* — Bao Q Truong
(74) *Attorney, Agent, or Firm* — Budzyn IP Law, LLC

(57) ABSTRACT

An improved and modular lighting fixture that reduces shipping and storage requirements and costs, facilitates simple assembly and repair, and that is modularly configurable to provide flexibility when designing and installing lighting fixtures. The improved lighting fixture also reduces the adverse effect of external environmental factors such as moisture, dust, etc. by providing a seal that impedes ingress into the modular lighting fixture.

11 Claims, 10 Drawing Sheets

MODULAR LIGHTING FIXTURE

FIELD OF THE INVENTION

The present invention is directed to an improved modular lighting fixture.

BACKGROUND OF THE INVENTION

Solid-state lighting fixtures are fast-replacing traditional (i.e., incandescent, fluorescent, etc.) lighting fixtures because of their longevity, reliability, low operating cost, durability, safety, and flexibility of design. As installation of solid-state lighting fixtures increases, so too does the types of environments in which they are installed. Some of these environments require more than a simple lighting source. For example, installation in an industrial environment may require a lighting fixture capable of withstanding a harsh or caustic environment. And even though the solid-state lighting source is more robust than traditional sources, the need still exists to protect the lighting source from external elements like moisture, duct, etc.

Solid-state lighting fixtures are known in the prior art, such as that shown in U.S. Pat. No. 8,888,315 to Edwards et al. These fixtures may be provided with sealed lens covers which resist the ingress of moisture, vapor and other contaminants into the fixtures, thus making the fixtures generally weatherproof and useable in various indoor, outdoor and indoor/outdoor environments. Such light fixtures are well-suited for vandal-resistant, dust, wet, and/or spray-down locations, such as parking garages, tunnels, temporary construction lighting, food processing and walk-in freezers, under awnings, car washes and wash bays, farms and barns, subways, laundry facilities and sport arenas.

It is also desirable to be able to design and install solid-state lighting fixtures of various lengths and configurations to accommodate the various applications and environments requiring such fixtures. There are limits on the length of solid-state lighting fixtures imposed by coast, storage and shipping requirements, and installation constraints.

It is thus desirable to provide a solid-state lighting fixture that address and overcomes the above-described shortcomings of the prior art.

SUMMARY OF THE INVENTION

An embodiment of the present invention is directed to a modular lighting fixture comprising a first sub-assembly including, a first tray having a first solid-state lighting element, a first housing element sized and shaped to accommodate the first tray, and a first lens positionable in contact engagement with the first housing element and overlaying at least a portion of the first solid-state lighting element so that light generated by the first solid-state lighting element may transmissively pass through the first lens. The modular lighting fixture further comprises a second sub-assembly including, a second tray having a second solid-state lighting element, a second housing element sized and shaped to accommodate the second tray, and a second lens positionable in contact engagement with the second housing element and overlaying at least a portion of the second solid-state lighting element so that light generated by the second solid-state lighting element may transmissively pass through the second lens. The modular lighting fixture still further comprises a coupling for joining the first and second sub-assemblies, the first tray and the second tray being connected directly to the coupling.

In an embodiment of the present invention, the first housing element and the second housing element are connected directly to the first tray and the second tray, respectively, and the first lens and the second lens are connected directly to the first housing element and the second housing element, respectively In an embodiment of the present invention, the coupling further comprises a first face having a first mounting element and a second face having a second mounting element, one of the first tray and the second tray being connected directly to the first mounting element, and the other one of the first tray and the second tray being connected directly to the second mounting element.

An embodiment of the present invention further comprises a seal between at least one of the first housing element, the first lens, and the coupling.

An embodiment of the present invention further comprises a seal between at least one of the second housing element, the second lens, and the coupling.

In an embodiment of the present invention, a part of the coupling comprises at least part of the seal.

In an embodiment of the present invention, a part of one of the first housing element and the first lens comprises at least part of the seal.

In an embodiment of the present invention, a part of one of the second housing element and the second lens comprises at least part of the seal.

An embodiment of the present invention further comprises a seal between at least one of the second housing element, the second lens, and the coupling.

An embodiment of the present invention further comprises a seal between at least one of the first housing element, the first lens, and the coupling.

In an embodiment of the present invention, one of the first housing element and the first lens, and one of the second housing element and the second lens have an open end located proximate the coupling when the first and second sub-assemblies are joined.

In an embodiment of the present invention, the first housing element and the first lens, and the second housing element and the second lens each have an open end located proximate the coupling when the first and second sub-assemblies are joined.

In an embodiment of the present invention, one of the first housing element and the first lens, and one of the second housing element and the second lens have two open ends, one open end being located proximate the coupling when the first and second sub-assemblies are joined.

In an embodiment of the present invention, the first solid-state lighting element and the second solid-state lighting element each comprises an LED.

An embodiment of the present invention further comprises a first clip secured to the first housing element, and a second clip secured to the second housing element, the first clip being connectable directly to the first tray, and the second clip being connectable directly to the second tray.

BRIEF DESCRIPTION OF THE DRAWINGS

Embodiments of the present invention will now be described with reference to the following diagrams, wherein.

DESCRIPTION OF EMBODIMENTS OF THE INVENTION

Figure 1:
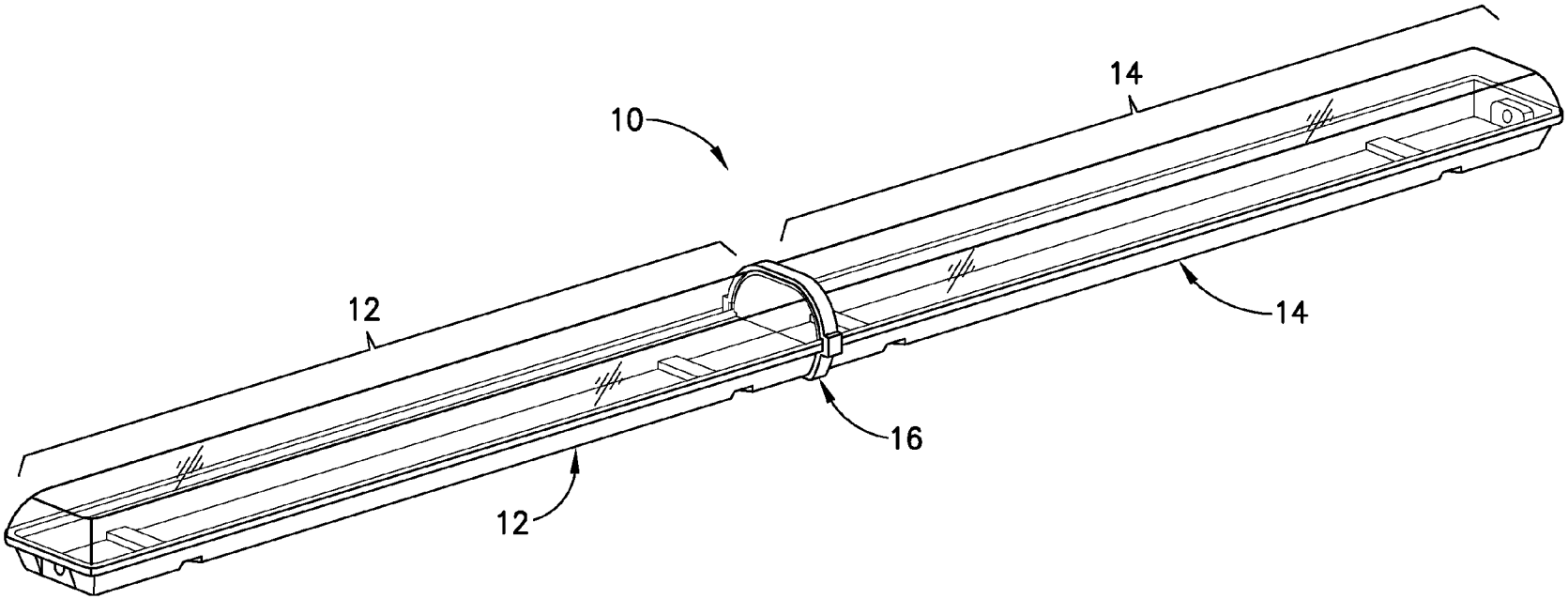
FIG. 1 is a perspective view of a modular lighting fixture in accordance with embodiments of the present invention.
Figure 2:
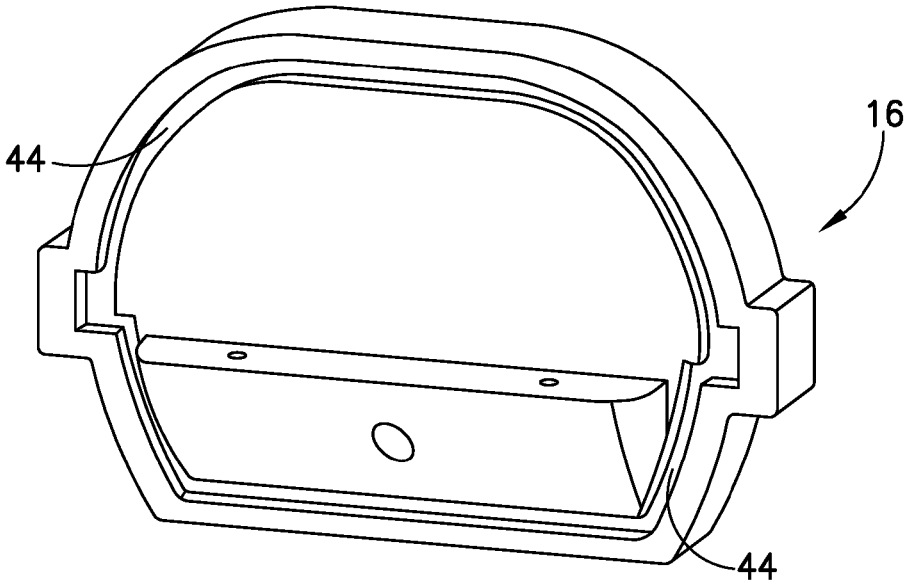
FIG. 2 is a perspective view of a coupling for a modular lighting fixture in accordance with embodiments of the present invention.
Figure 3:
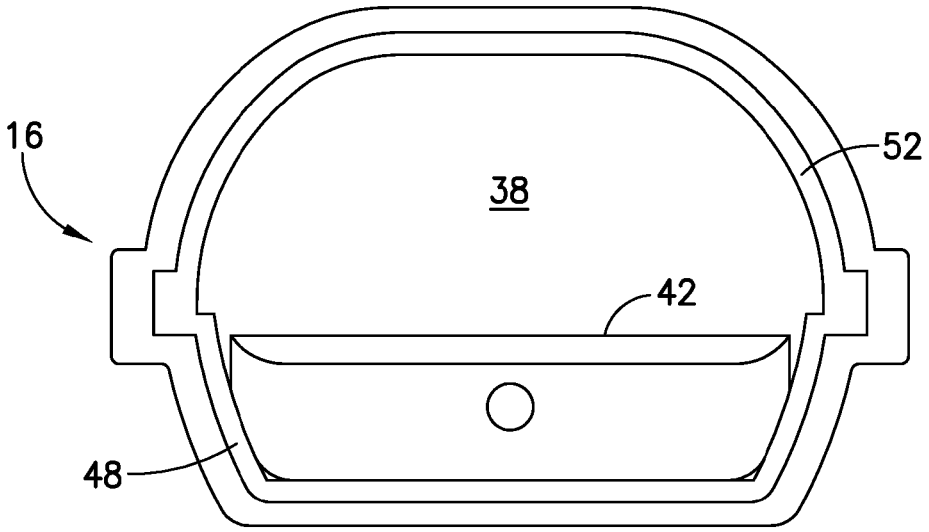
FIG. 3 is a front view of a coupling for a modular lighting fixture in accordance with embodiments of the present invention.
Figure 4:
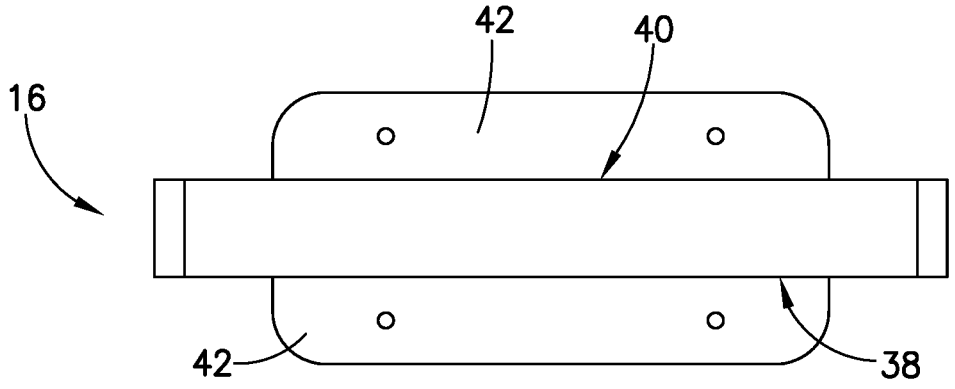
FIG. 4 is a top view of a coupling for a modular lighting fixture in accordance with embodiments of the present invention.
Figure 5:
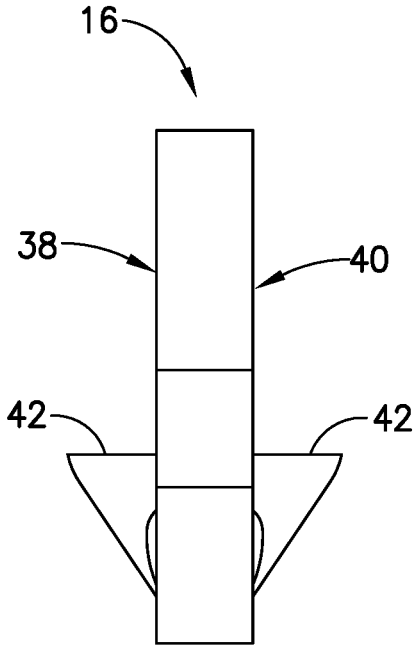
FIG. 5 is a side view of a coupling for a modular lighting fixture in accordance with embodiments of the present invention.
Figure 6:
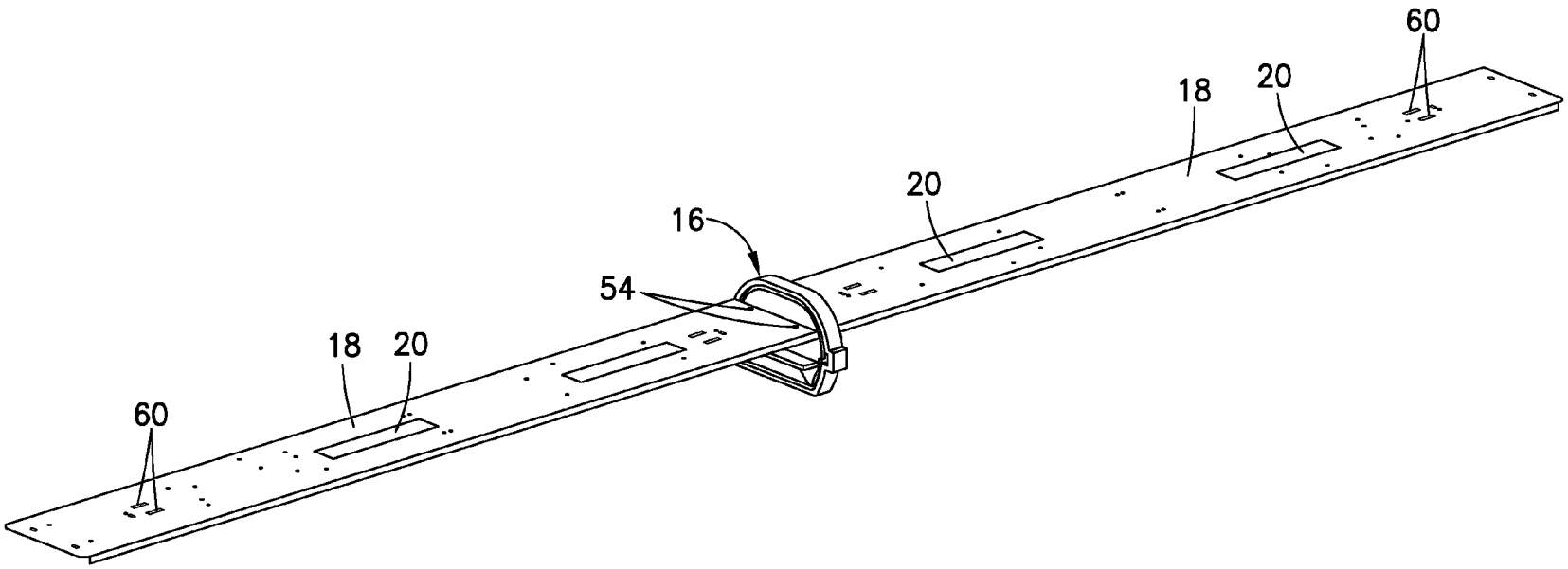
FIG. 6 depicts two trays positioned near a coupling of a modular lighting fixture in accordance with embodiments of the present invention.
Figure 7:
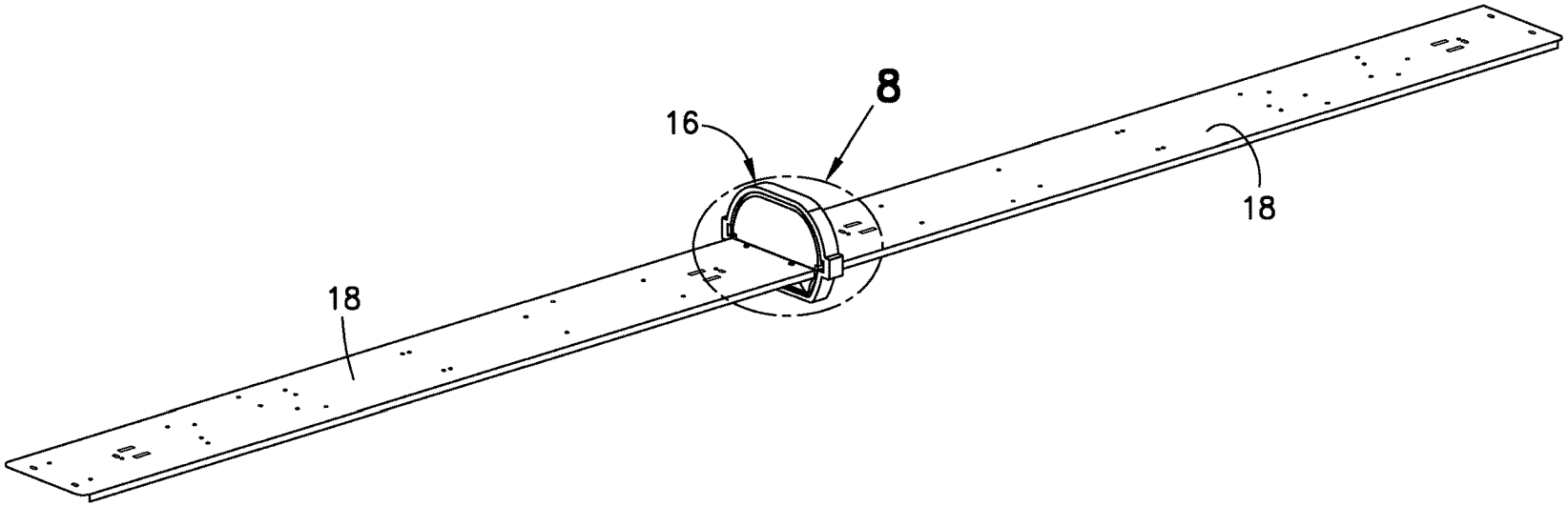
FIG. 7 depicts two trays fastened to a coupling of a modular lighting fixture in accordance with embodiments of the present invention.
Figure 8:
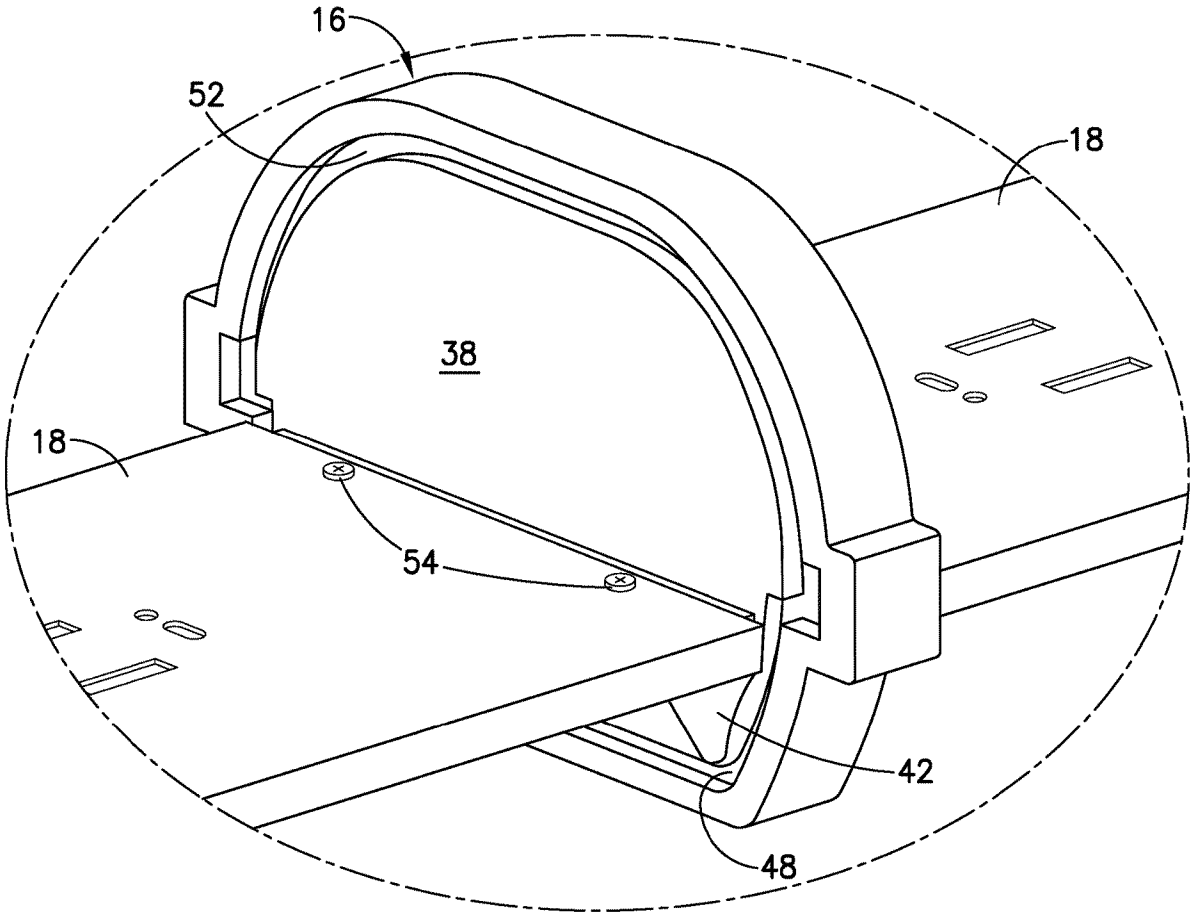
FIG. 8 is the view 8-8 of FIG. 7.

The present invention provides an improved and modular lighting fixture that reduces shipping and storage requirements and costs, facilitates simple assembly and repair, and that is modularly configurable to provide flexibility when designing and installing lighting fixtures. The present invention also provides a modular lighting structure that is environmentally rugged, and generally resistant to external environmental incursions (e.g., moisture, dust, etc.).

With reference to FIGS. 1-13, the present invention will now be discussed in detail. A modular lighting fixture 10 is shown which generally includes a first sub-assembly 12, a second sub-assembly 14 and a coupling 16 for joining the first and second sub-assemblies 12, 14. The description herein, for illustrative purposes, discusses the use of two sub-assemblies. As will be recognized by those skilled in the art, additional sub-assemblies may be utilized consistent with the description herein.

Each of the sub-assemblies 12, 14 includes a tray 18 having a solid-state lighting element 20 associated therewith. A plurality of solid-state lighting elements 20 may be provided. The solid-state lighting elements 20 may be in any known form, including being in LED form. The solid-state lighting elements 20 include not only light generating elements, e.g., the LEDs, but also any associated circuitry, (e.g., drivers, switches, controls, dimmers, motion sensors, daylight sensors, etc.) and wiring, including wiring for connecting to external power supplies and controls.

The sub-assemblies 12, 14 also each include a housing element 22 for accommodating the associated tray 18. The housing element 22 may be trough-shaped and dimensioned to allow for the associated tray 18 to be at least partially seated therewithin. A lens 24 is also provided for each of the sub-assemblies 12, 14 configured to overlay at least a portion of the solid-state lighting elements 20 of the associated tray 18 so that light generated by the solid-state lighting elements 20 may transmissively pass through the lens 24. The lens 24 may be formed of any material, including being formed of glass and/or a thermoplastic material and may be formed clear or frosted.

Preferably, the tray 18, the housing element 22 and the lens 24 of each of the sub-assemblies 12, 14 are connectable so as to join together to form the respective sub-assembly. Any manner or mode of connection may be utilized. By way of non-limiting example, clips 26 having resilient arms 58 may be provided to attach between the tray 18 and the associated housing element 22. Latches 28 may be provided to removably secure the lens 24 to the associated housing element 22.

It is preferred that the tray 18 be fully seated within the associated housing element 22. In this manner, the tray 18 may be completely sealed from the external environment. In addition, it is preferred that one or more sealing elements 30 be provided to define a seal along the interface between the lens 24 and the associated housing element 22. By way of non-limiting example, the housing element 22 may be formed with an indented ridge 32 that is sized and shaped to receive the sealing elements 30. The indented ridge 32 is sized and configured so that edge contact is achieved between the housing element 22 and an edge 70 of the lens 24, with the lens 24 being assembled with the associated housing element 22. As can be seen in the Figures, with the first and second sub-assemblies 12, 14 being utilized, i.e., two of the sub-assemblies being utilized, outer end 34 of each of the housing elements 22 is formed closed and the outer end 36 of each of the lenses 24 is also formed closed. It is preferred that the sealing elements 30 extend along the full edge of each of the housing elements 22, including outer ends 34, intended for interfacing with the associated lens 24. In an alternative embodiment, a housing element 22 and lens 36 may be provided that are each opened at both ends to enable connection to a coupling at both ends thereby providing a longer lighting assembly 10.

Each of the first and second sub-assemblies 12, 14 is joined to the coupling 16 in forming the lighting fixture 10. Any manner of joining may be utilized. For example, portions of the tray 18 and/or the housing element 22 and/or the lens 24 of each of the sub-assemblies 12, 14 may be affixed to the coupling 16. By way of non-limiting example, the tray 18 of each of the first and second sub-assemblies 12, 14 may be secured to the coupling 16, using any known mode of connection, including fasteners such as screw fasteners 54.

The coupling 16 may be plate-shaped with opposing first and second faces 38, 40. At least one mounting element 42 may be provided on each of the first and second faces 38, 40. By way of non-limiting example, the mounting element 42 may be a protruding shelf to which the associated tray 18 may be fastened, for example, using screw fasteners 54. The tray 18 of the first sub-assembly 12 may be affixed adjacent the first face 38 of the coupling 16, and the tray 18 of the second sub-assembly 14 may be affixed adjacent the second face 40 of the coupling 16. This partially allows for the coupling 16 to join the first and second sub-assemblies 12, 14.

As will be appreciated by those skilled in the art, in addition to, or alternatively to, the tray 18 being secured to the coupling 16, the housing element 22 and/or the lens 24 of the sub-assemblies 12, 14 may be secured to the coupling 16.

With the lighting fixture 10 being useable for moisture resistant applications, sealing may be provided at least partially along the interfaces between the sub-assemblies 12, 14 and the coupling 16, and between the housing elements 22 and lenses 24. At least one coupling sealing element 44 may be provided to form a seal, preferably, a moisture resistant seal, at least at or near open end 46 of the housing element 22 of each of the sub-assemblies 12, 14. Preferably, a slot 48 is formed in each of the first and second faces 38, 40 to match the profile of the open end 46 of the associated housing element 22. The coupling sealing element 44 may be seated within the slot 48. Seals may be formed with insertion of the open ends 46 of the housing elements 22 into the slots 48 on the first and second faces 38, 40. Optionally, the coupling sealing element 44 may be also provided to form a seal, possibly a moisture resistent seal, at least at or near open end 50 of the lens 24 of each of the sub-assemblies 12, 14. A secondary slot 52 may be formed in each of the first and second faces 38, 40 formed to match the profile of the open end 50 of the associated lens 24. The coupling sealing element 44 may be seated within the secondary slot 52. Seals may be formed with insertion of the open ends 50 of the lenses 24 into the secondary slots 52 on the first and second faces 38, 40. As shown in the Figures, the slot 48 and the secondary slot 52 on each of the first and second faces 38, 40 may be formed to be continuous, with the coupling sealing element 44 being continuous therein. This defines a closed-loop channel for both receiving an end of a sub-assembly and for defining a seal at the interface therewith.

The coupling sealing elements 44, optionally, may be provided fully and/or partially on portions of the sub-assemblies 12, 14. Also, the constituent material of the coupling 16, the housing elements 22, and/or the lens 24 may have inherent characteristics which allow for moisture resistant seal formation without the provision of an external sealing element. For example, the constituent material of the coupling 16 and/or the lens 24 may allow for a moisture resistant seal to be formed therebetween without an external sealing member. An interfering or a compression fit may be required.

It is preferred that the lighting fixture 10 be prepared in component form, with the trays 18, the housing elements 22, the lenses 24, and the coupling 16 being each prepared, but not assembled to one another, for storage and shipping. The components are each prepared in working order, including the tray 18 having all proper wiring for the solid-state lighting elements 20. The components are stored and shipped as a kit ready for simple assembly and installation.

To illustrate a possible embodiment of the subject invention, particularly with respect to assembly thereof, reference is made to FIGS. 6-11, where, in an initial step, the trays 18 are positioned adjacent the coupling 16 ready for assembly. Each tray 18 is connected to the coupling 16 (opposite sides), using screw fasteners 54. The trays 18 may be secured to the mounting elements 42 provided on the first and second faces 38, 40. Screw holes may be pre-drilled in the mounting elements 42 to facilitate assembly.

Figure 9:
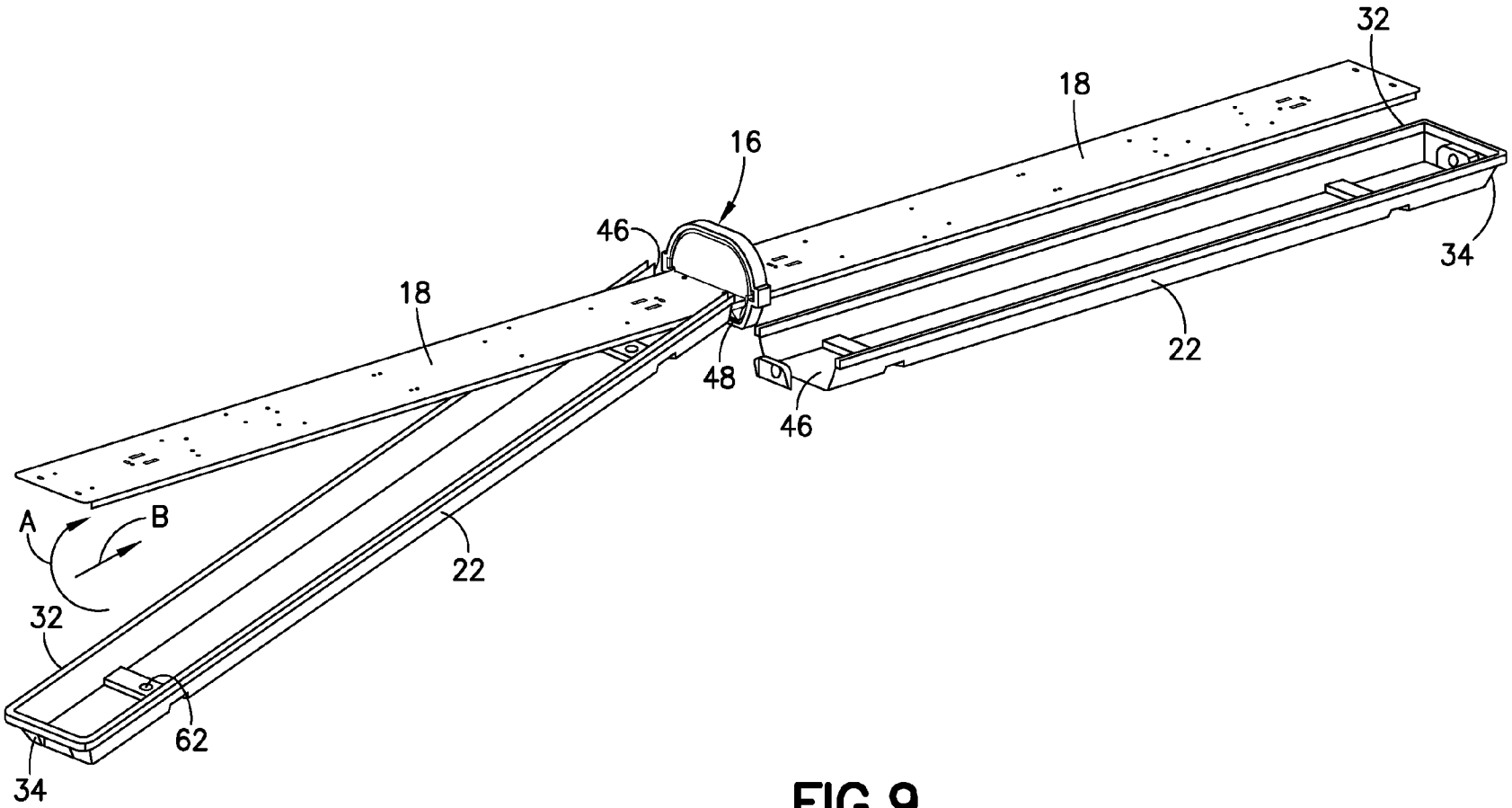
FIG. 9 depicts housing elements, trays and the coupling and detail of a clip being assembled in accordance with embodiments of the present invention.
Figure 10:
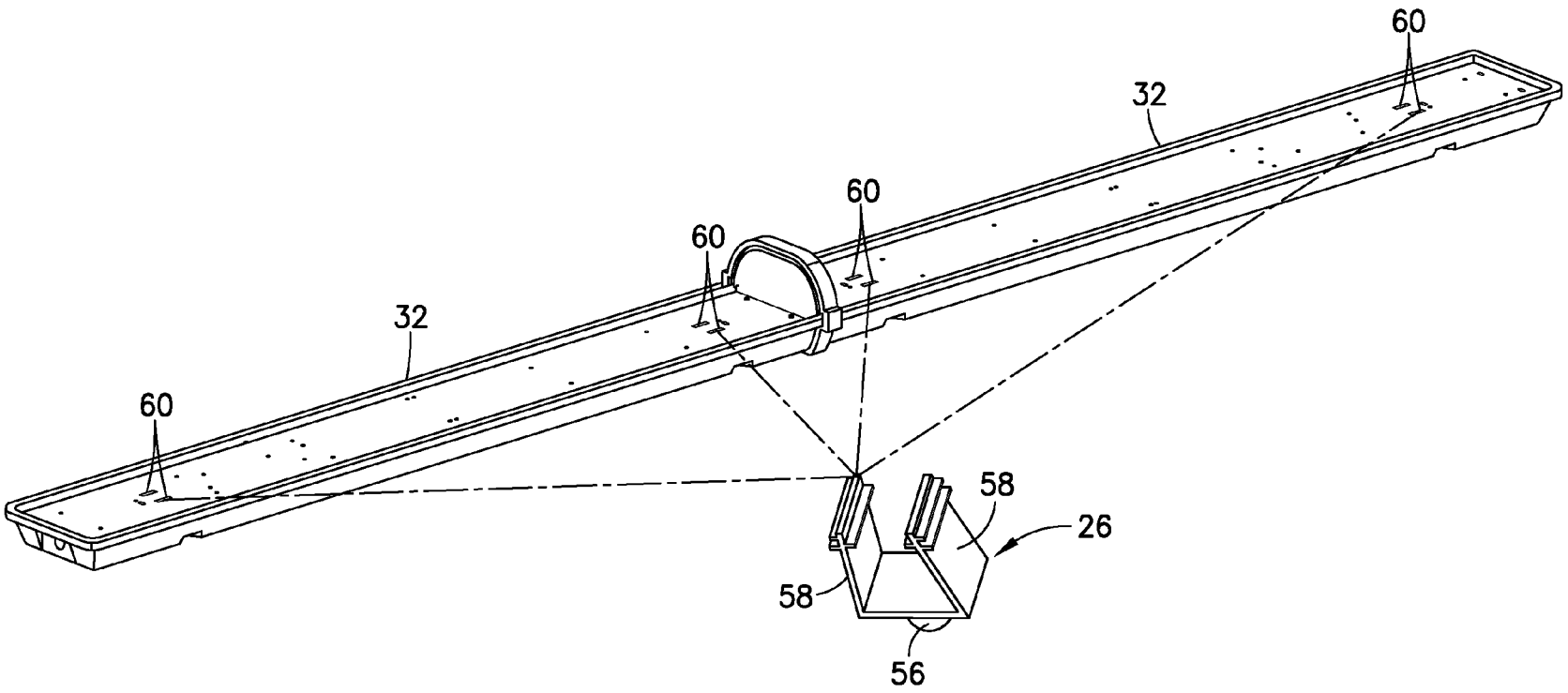
FIG. 10 depicts housing elements, trays and the coupling being assembled in accordance with embodiments of the present invention.

With the trays 18 being fixed to the coupling 16, the housing elements 22 are introduced from below on opposite sides of the coupling 16, as shown in FIG. 9 by locating the open end 46 proximate the coupling 16 and the slot 48. Having been previously secured to the housing element 22 in receptacle 62, the clips 26 may be used to secure the housing elements 22 to the associated trays 18. As shown in FIG. 10, each clip 26 comprises a locking member 56 for frictionally and/or interferingly engaging the receptacle 62 of the associated housing element 22. Each clip 26 further comprises resilient arms 58 formed to snap engage slots 60 formed in the associated tray 18. It is preferred that the clips 26 be fastened to the housing elements 22 prior to securing the housing elements 22 to the coupling 16. To assemble the housing element 22, tray 18 and coupling 16, the housing elements 22 are caused to move both axially towards the coupling 16 and rotatedly upwardly towards the associated trays 18, as shown by arrows A and B in FIG. 9. In this manner, the open ends 46 of the housing elements 22 are seated within the slots 48 and the clips 26 are caused to engage the trays 18, thus, joining together the coupling 16, the trays 18 and the housing elements 22. The snap engagement of the clips 26 with the trays 18 may provide audible confirmation of attachment.

Figure 11:
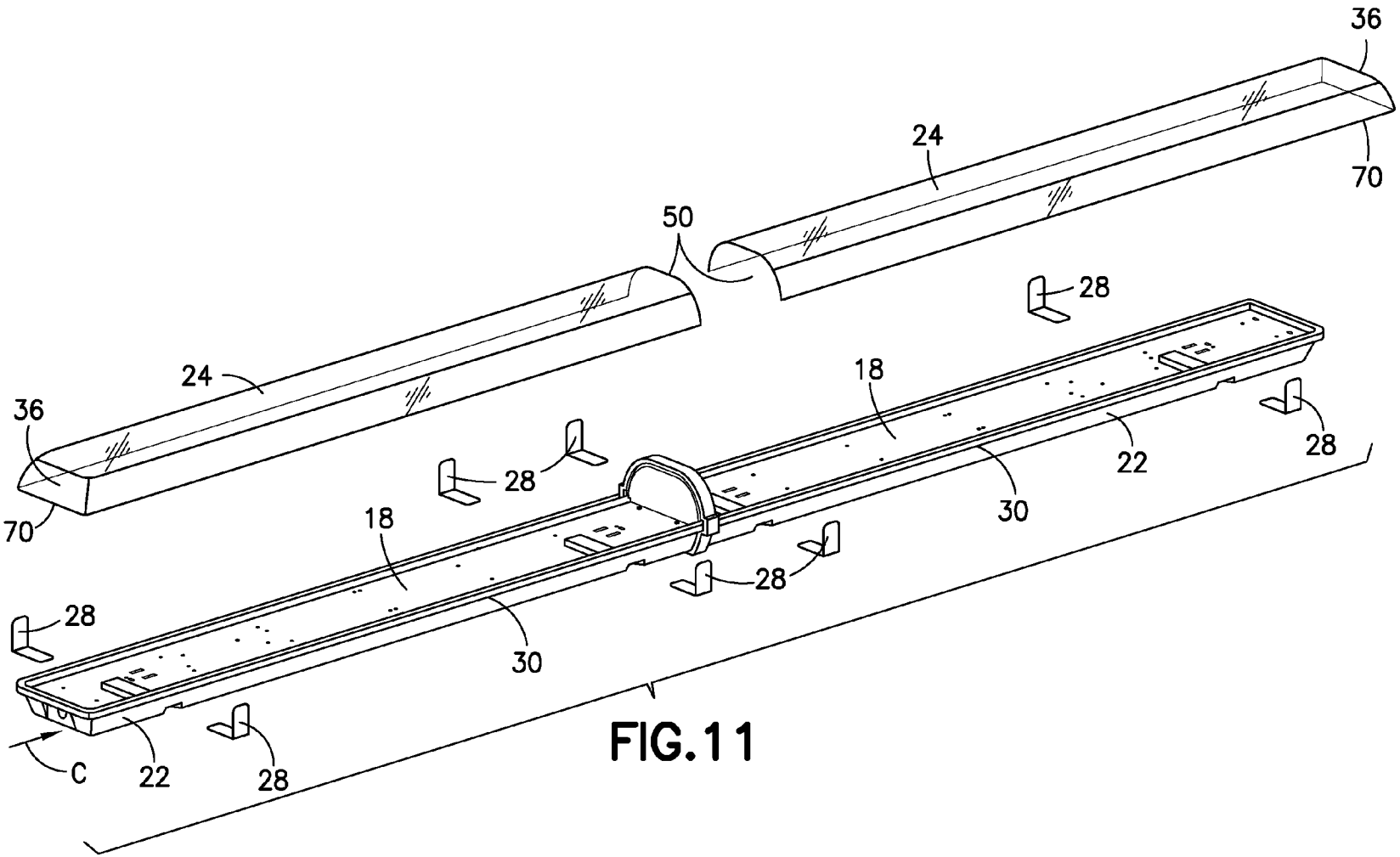
FIG. 11 is a perspective view of a modular lighting fixture being assembled in accordance with embodiments of the present invention.
Figure 12:
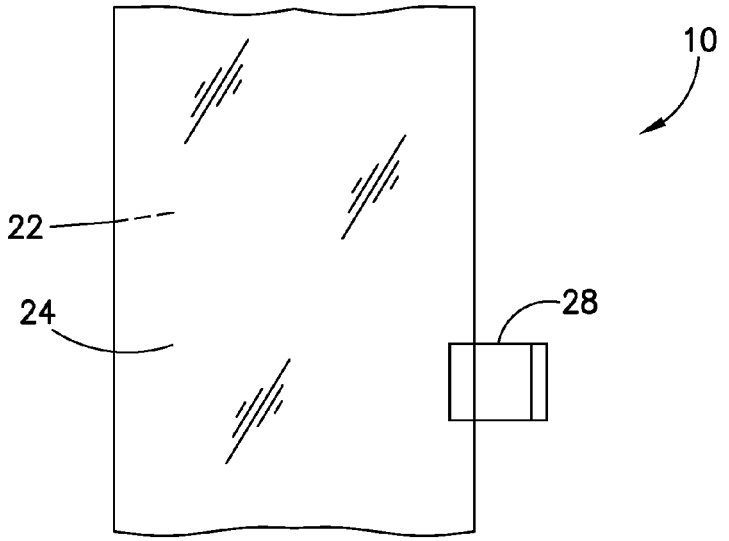
FIG. 12 depicts a detailed view of a latch to secure a lens and a housing element in accordance with embodiments of the present invention.
Figure 13:
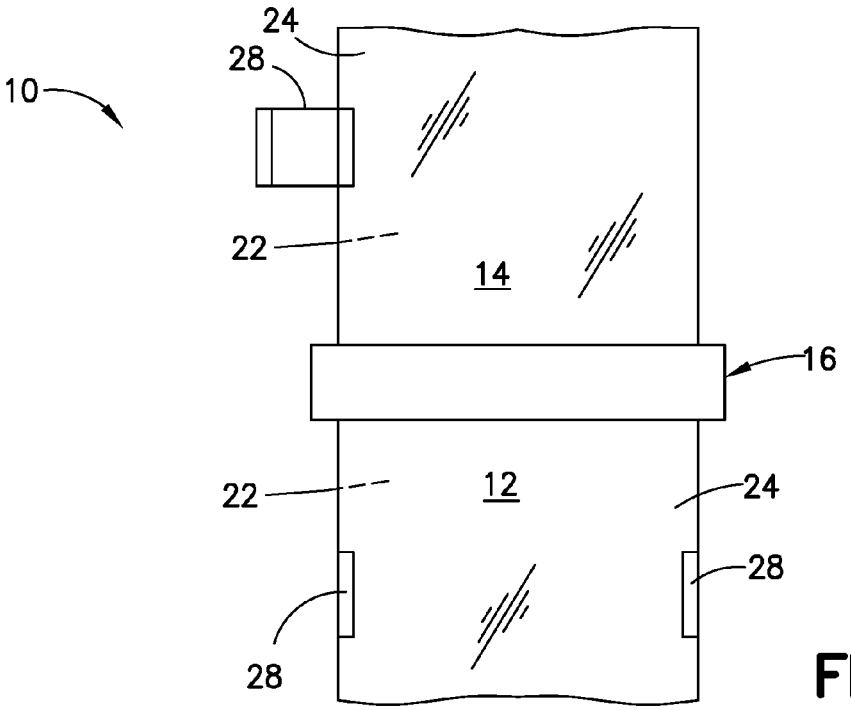
FIG. 13 depicts a detailed view of a coupling and a latch to secure a lens and a housing element in accordance with embodiments of the present invention.

Thereafter, the lens 24 of each of the sub-assemblies 12, 14 is introduced, and caused to be lowered into engagement with the associated housing element 22, and, urged towards the coupling 16, as shown schematically by arrow C in FIG. 11. This allows for the lenses 24 to be seated with the associated housing elements 22 and within the secondary slots 52 of the coupling 16. Thereafter, the latches 28 may be utilized to releasably fix the lenses 24 to the associated housing elements 22. As a result of this assembly, the lighting fixture 10 is provided as a completed assembly.

It is noted that the housing elements 22 may include openings and/or knock-outs which allow for wiring to pass into and out of the lighting fixture 10 as needed. Any such external wiring may be sealed where passing through the housing elements 22 with any known techniques, particularly if the vapor-tightness of the lighting fixture 10 may be denigrated.

It is additionally noted that the lighting fixture 10 may include more than two sub-assemblies. This would require additional couplings 16 as needed. In addition, sub-assemblies which would be located internally of two of the couplings 16 would have to be modified to have two open ends rather than one open end and one closed end. The internal sub-assemblies would be joined to a coupling on each end in the manner described above.

Embodiments of the present invention thus provide a modular lighting fixture that may be selectively configurable to a variety of lengths. Using the inventive coupling 16, the present invention eliminates the need to store, package and ship long lighting fixtures by providing a modular lighting fixture that can be assembled on-site and configured to a variety of lengths. The present invention also provides a modular lighting fixture with improved impermeability to external environment incursions (e.g., moisture, dust, etc.).

Although specific example embodiments have been described, it will be evident that various modifications and changes may be made to these embodiments without departing from the broader scope of the inventive subject matter described herein. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This description, therefore, is not to be taken in a limiting sense, and the scope of various embodiments is defined only by the appended claims, along with the full range of equivalents to which such claims are entitled.

What is claimed is:

1. A modular lighting fixture comprising:

a first sub-assembly including:

a first tray having a first solid-state lighting element;

a first housing element sized and shaped to accommodate the first tray; and a first lens positionable in contact engagement with the first housing element and overlaying at least a portion of the first solid-state lighting element so that light generated by the first solid-state lighting element may transmissively pass through the first lens;

a second sub-assembly including:

a second tray having a second solid-state lighting element;

a second housing element sized and shaped to accommodate the second tray; and a second lens positionable in contact engagement with the second housing element and overlaying at least a portion of the second solid-state lighting element so that light generated by the second solid-state lighting element may transmissively pass through the second lens;

a coupling for joining the first and second sub-assemblies, the first tray and the second tray being connected directly to the coupling, and a seal between at least one of the first housing element, the first lens, and the coupling, wherein a part of the coupling comprises at least part of the seal.

2. The modular lighting fixture of claim 1, wherein the first housing element and the second housing element are connected directly to the first tray and the second tray, respectively, and the first lens and the second lens are connected directly to the first housing element and the second housing element, respectively.

3. The modular lighting fixture of claim 1, wherein the coupling further comprises a first face having a first mounting element and a second face having a second mounting element, one of the first tray and the second tray being connected directly to the first mounting element, and the other one of the first tray and the second tray being connected directly to the second mounting element.

4. The modular lighting fixture of claim 1, further comprising a second seal between at least one of the second housing element, the second lens, and the coupling.

5. The modular lighting fixture of claim 1, wherein a part of at least one of the first housing element and the first lens comprises at least part of the seal.

6. The modular lighting fixture of claim 4, wherein a part of at least one of a part of the coupling, the second housing element and the second lens comprises at least part of the second seal.

7. The modular lighting fixture of claim 1, wherein one of the first housing element and the first lens, and one of the second housing element and the second lens have an open end located proximate the coupling when the first and second sub-assemblies are joined.

8. The modular lighting fixture of claim 1, wherein the first housing element and the first lens, and the second housing element and the second lens each have an open end located proximate the coupling when the first and second sub-assemblies are joined.

9. The modular lighting fixture of claim 1, wherein one of the first housing element and the first lens, and one of the second housing element and the second lens have two open ends, one open end being located proximate the coupling when the first and second sub-assemblies are joined.

10. The modular lighting fixture of claim 1, wherein the first solid-state lighting element and the second solid-state lighting element each comprises an LED.

11. The modular lighting fixture of claim 2, further comprising a first clip secured to the first housing element, and a second clip secured to the second housing element, the first clip being connectable directly to the first tray, and the second clip being connectable directly to the second tray.

* * * * *